US008636134B2

(12) United States Patent
Fargo

(10) Patent No.: US 8,636,134 B2
(45) Date of Patent: Jan. 28, 2014

(54) MOVING SKIRT MECHANISM FOR CHAIN DRIVEN PASSENGER CONVEYORS

(75) Inventor: Richard N. Fargo, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 201 days.

(21) Appl. No.: 13/128,963

(22) PCT Filed: Dec. 22, 2008

(86) PCT No.: PCT/US2008/013961

§ 371 (c)(1),
(2), (4) Date: May 12, 2011

(87) PCT Pub. No.: WO2010/074669

PCT Pub. Date: Jul. 1, 2010

(65) Prior Publication Data

US 2011/0233029 A1 Sep. 29, 2011

(51) Int. Cl.
*B66B 23/12* (2006.01)
*B66B 23/08* (2006.01)

(52) U.S. Cl.
USPC ..... 198/327; 198/326; 198/330

(58) Field of Classification Search
USPC ..... 198/326, 327, 330
See application file for complete search history.

(56) References Cited

U.S. PATENT DOCUMENTS

| | | | | |
|---|---|---|---|---|
| 800,783 | A * | 10/1905 | Adkins et al. | 198/330 |
| 2,005,067 | A * | 6/1935 | Graff-Baker | 198/330 |
| 3,986,595 | A | 10/1976 | Asano et al. | |
| 4,397,383 | A | 8/1983 | James | |
| 4,470,497 | A | 9/1984 | Kraft | |
| 5,325,955 | A | 7/1994 | Ahls et al. | |
| 5,695,040 | A | 12/1997 | Watanabe et al. | |
| 6,213,278 | B1 | 4/2001 | Tanigawa | |
| 6,450,316 | B1 | 9/2002 | Stuffel et al. | |
| 6,640,957 | B2 * | 11/2003 | Fargo et al. | 198/321 |
| 6,868,956 | B2 * | 3/2005 | Hauer et al. | 198/333 |
| 7,140,484 | B2 | 11/2006 | Stuffel et al. | |
| 7,222,713 | B2 | 5/2007 | Hauer et al. | |

FOREIGN PATENT DOCUMENTS

| | | | | |
|---|---|---|---|---|
| CN | 1476411 A | | 2/2004 | |
| CN | 1630614 A | | 6/2005 | |
| CN | 1741957 A | | 3/2006 | |
| DE | 2346266 | * | 3/1975 | B66B 9/12 |
| JP | 03211186 A | * | 9/1991 | B66B 21/02 |

(Continued)

OTHER PUBLICATIONS

The May 28, 2009 International Search Report for Counterpart International application No. PCT/US2008/013961.

(Continued)

*Primary Examiner* — Gene Crawford
*Assistant Examiner* — Matthew Marotta
(74) *Attorney, Agent, or Firm* — Kinney & Lange, P.A.

(57) ABSTRACT

A tread plate assembly for a passenger conveyer system includes a first tread plate projecting from a first skirt plate, a second tread plate projecting from a second skirt plate and arranged adjacent the first tread plate, a link pivotally connected to the first skirt plate and slidably and pivotally connected to the second skirt plate, and a bridge member connected to the link and arranged between the first skirt plate and the second skirt plate to form a moving skirt of the passenger conveyer system.

22 Claims, 5 Drawing Sheets

(56) References Cited

FOREIGN PATENT DOCUMENTS

| | | | |
|---|---|---|---|
| JP | 05-085690 | A | 4/1993 |
| JP | 06-009184 | A | 1/1994 |
| JP | 2000327248 | A | 11/2000 |
| JP | 2003256976 | | 9/2003 |
| JP | 2003265976 | | 9/2003 |
| WO | WO 02/44071 | A1 | 6/2002 |

OTHER PUBLICATIONS

The Chinese Search Report translation dated Jan. 14, 2013 for China Application No. 200880132443.9.

The Chinese First Office Action dated Jan. 24, 2013 for China Application No. 200880132443.9.

* cited by examiner

FIG. 2A
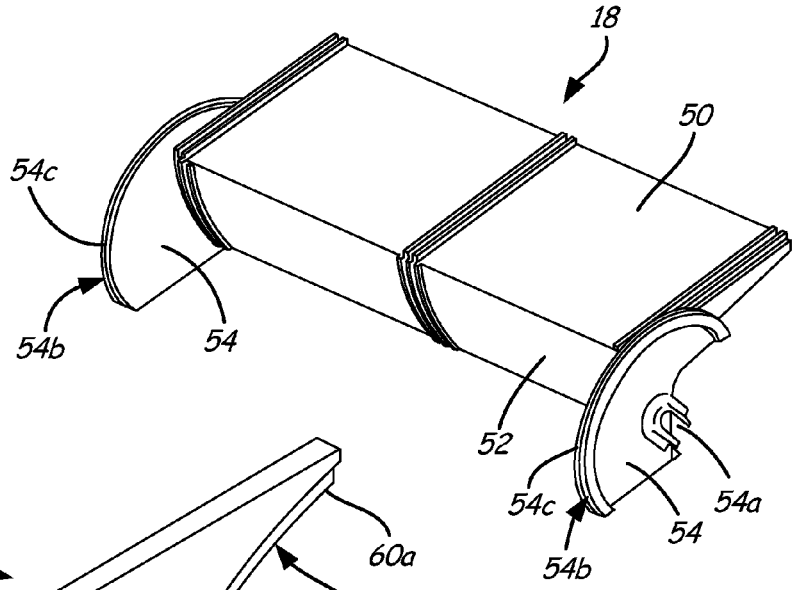
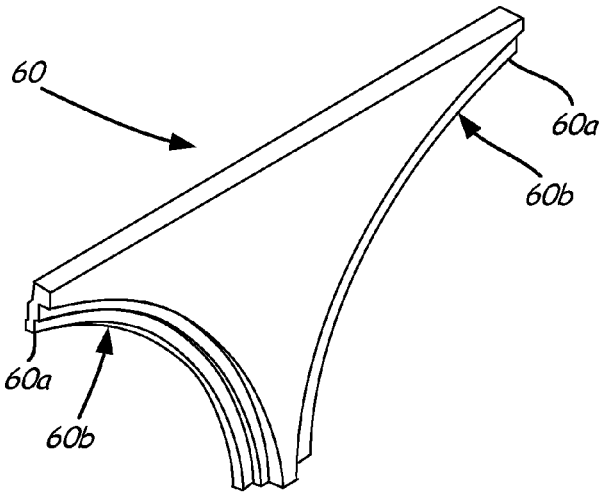
FIG. 2B
FIG. 2C
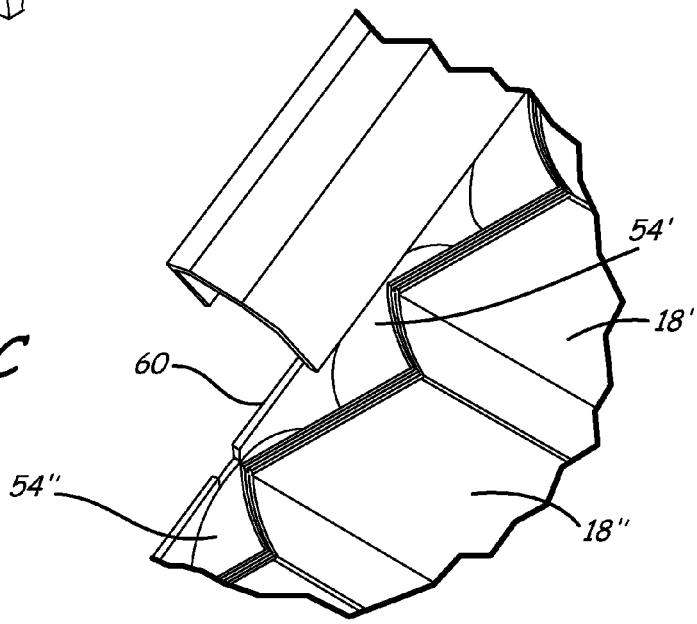

MOVING SKIRT MECHANISM FOR CHAIN DRIVEN PASSENGER CONVEYORS

CROSS-REFERENCE TO RELATED APPLICATION(S)

This application claims priority to, and hereby incorporates by reference in its entirety, PCT International Application No. PCT/US2008/013961, which was filed on Dec. 22, 2008.

BACKGROUND

The present invention relates to a passenger conveyor system, and more particularly to a mechanism for a moving skirt in chain driven escalators and moving walks.

A typical passenger conveyor, such as an escalator or moving walk, includes a series of tread plates, a frame, a drive, a step chain and a pair of balustrade assemblies. The frame comprises a truss section on both the left and right hand sides of the frame. Each truss section has two end sections forming landings, connected by an inclined midsection. Matching pairs of roller tracks are attached on the inside of each truss section, i.e. the side of the truss section facing the other truss section. The upper landing usually houses the escalator drive between the trusses. The drive powers a pair of step chain sprockets, which in turn impart motion to the step chain to move the tread plates. The step chain and tread plates travel a closed loop, running from one elevation to the other elevation, and back.

Step chains typically include a pair of chain strands connected by a plurality of axles, each axle having a pair of rollers that contact the roller tracks. The tread plates are connected to the axles. The chain strands are attached to the axle inside of the rollers. Each strand is formed from a plurality of chain links. Because there are commonly a number of chain links between axles and thereby between successive tread plates in a chain driven escalator, the spacing between adjacent tread plates may vary in transition regions of the closed loop path as the multiple chain links follow the non-linear shape of the transition regions.

The individual steps of an escalator typically move in a very narrow "channel" defined by panel elements that are commonly referred to as the skirt boards. These skirt boards are attached to the frame of the escalator, and therefore remain fixed as the steps move therebetween. The gap between the steps and the skirt board is kept very small to decrease the likelihood that objects or body parts of passengers are pulled into and trapped in this gap. Designing escalators with a very small gap between steps and skirt boards significantly increases installation and maintenance costs and complexity. Some escalators therefore employ a moving skirt, also known as a guarded step, by providing a skirt board that moves with the steps. Moving skirts substantially remove the risk of trapping objects and passenger body parts in the gap between the step and skirt boards, because there is no relative motion between the two components.

One design challenge in chain driven escalators that employ a moving skirt is designing the skirt boards such that they accommodate the articulated motion of the steps throughout the closed loop path through which they travel during operation. In particular, the skirt boards must be designed to comply with variations in adjacent step spacing in transition regions of the closed loop path, such as in the turnarounds in the upper and lower landings of the escalator.

SUMMARY

A tread plate assembly for a passenger conveyer system includes a first tread plate projecting from a first skirt plate, a second tread plate projecting from a second skirt plate and arranged adjacent the first tread plate, a link pivotally connected to the first skirt plate and slidably and pivotally connected to the second skirt plate, and a bridge member connected to the link and arranged between the first skirt plate and the second skirt plate to form a moving skirt of the passenger conveyer system.

BRIEF DESCRIPTION OF THE DRAWINGS

FIGS. 2A-2C are perspective views illustrating assemblies of adjacent steps of the escalator of FIG. 1.

DETAILED DESCRIPTION

Figure 1:
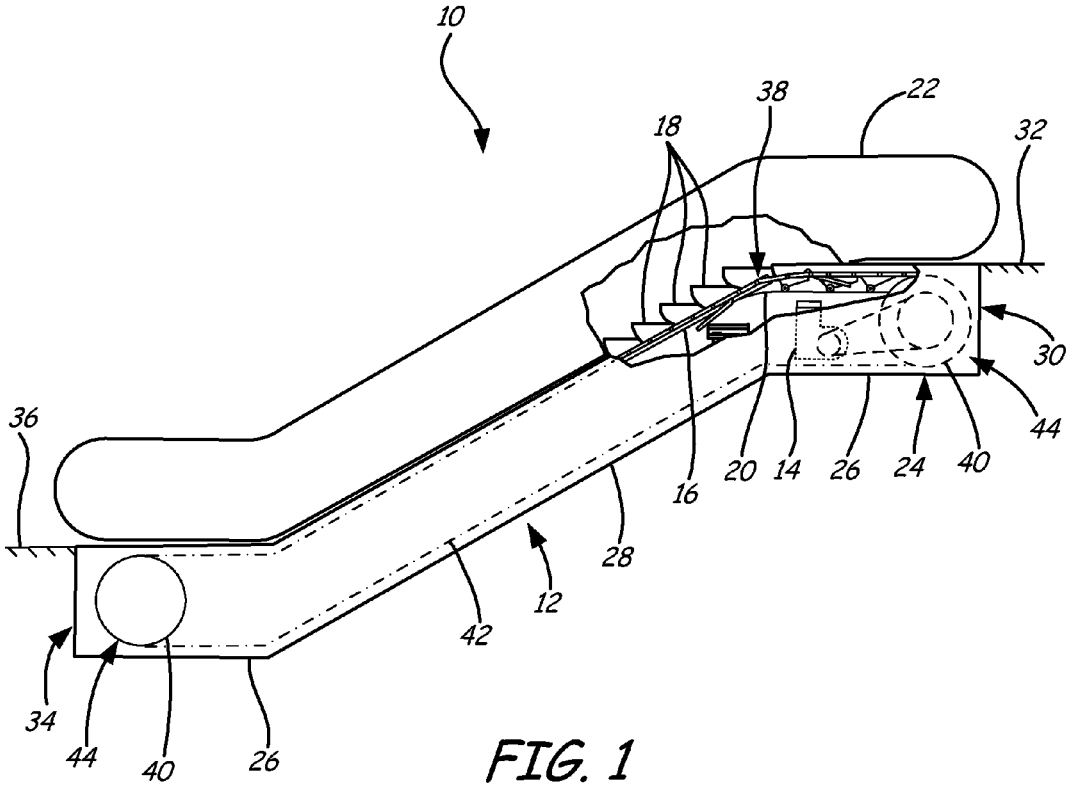
FIG. 1 is a schematic elevation view of an escalator.

FIG. 1 is schematic elevation view of escalator 10 including frame 12, drive 14, step chain 16, steps 18, roller tracks 20, and balustrade assemblies 22. Frame 12 includes truss section 24 on both the left and right hand sides of frame 12 (only one side is shown in FIG. 1). Each truss section 24 has two end sections 26 parallel to one another, connected by an inclined midsection 28. The end sections 26 form upper landing 30 at upper elevation 32 and lower landing 34 at lower elevation 36. Matching pairs of roller tracks 20 are attached on the inside of each truss section 24, i.e. the side of truss section 24 facing the other truss section 24. The region between inclined midsection 28 and landings 30, 34 in which the slope of roller track 20 is changing from the slope of incline 28 to the slope of landings 30, 34, is defined to be transition region 38 between inclined midsection 28 and either of landings 30, 34.

Upper landing 30 houses escalator drive 14, between truss sections 24. Drive 14 powers a pair of step chain sprockets 40, which in turn impart linear motion to step chains 16. Steps 18 are connected to step chains 16 and guided along roller tracks 20 as they are driven along with step chains 16 by escalator drive 14. Step chains 16 and steps 18 travel through closed loop path 42 (shown in phantom in FIG. 1), running from one elevation to the other elevation (32, 36), and back. The regions of the closed loop path through which step chains 16 and steps 18 travel include two turnarounds 44 as chain 16 and steps 18 travel around sprockets 40 at upper and lower landings 30, 34.

FIGS. 2A-2C are perspective views illustrating assemblies of adjacent steps 18 of escalator 10. FIG. 2A is a perspective view of step 18 including tread plate 50, riser 52, and skirt plates 54. Tread plate 50 and riser 52 are connected to form one step 18 of escalator 10. Tread plate 50 and riser 52 are connected to and project from one skirt plate 54 to the other. Skirt plates 54 are generally circular and include slot 54*a*. In escalator 10 shown in FIG. 1, step chains 16 are arranged generally in truss sections 24 toward the left and right sides of frame 12 (only one side of frame 12 and one step chain 16 is shown in FIG. 1). The two step chains 16 are connected by axles (not shown) spanning generally between the left and right sides of frame 12 and distributed throughout closed loop path 42 traveled by step chains 16. Slots 54*a* in skirt plates 54 are configured to connect step 18 to step chains 16 by receiving one of the axles joining both step chains 16 of escalator 10. Peripheral edges 54*b* of skirt plates 54 include grooves 54*c* adapted to receive a tongue to form a tongue and groove interface. FIG. 2B is a perspective view of bridge member 60, which is generally triangular and includes tongues 60*a* along peripheral edges 60*b*. Tongue 60*a* of bridge member 60 is configured to be received by groove 54*c* of skirt plate 54 to form a tongue and groove interface between bridge member 60 and skirt plate 54. Although in FIGS. 2A-2C skirt plate 54 includes groove 54*c* and bridge member 60 includes tongue 60*a*, alternative embodiments include skirt plates with tongues and bridge members with grooves configured to receive the skirt plate tongues to form a tongue and groove interface therebetween.

FIG. 2C is a partial perspective view of adjacent steps 18 assembled for operation in escalator 10. In FIG. 2C, first step 18' includes first skirt plate 54' and is arranged adjacent second step 18", which includes second skirt plate 54". Bridge member 60 is arranged between first skirt plate 54' and second skirt plate 54" to form a moving skirt of escalator 10. As described with reference to FIGS. 2A and 2B, tongues 60*a* (not shown in FIG. 2C) on bridge member 60 are configured to be received by grooves 54*a* on skirt plates 54', 54". Steps 18', 18" are shown in inclined portion 28 of closed loop path 42 through which they travel during operation of escalator 10. In this portion and in the flat portions of the upper and lower landings, the spacing between step 18' and step 18" will generally vary only slightly. Relatively small variations in the spacing between step 18' and step 18" may be accommodated by varying the tongue and groove interface between skirt plates 54', 54" and bridge member 60. For example, tongues 60*a* on bridge member 60 may be made larger and grooves 54*a* in skirt plates 54', 54" may be made deeper to account for small spacing variations between adjacent steps 18', 18". However, in transition regions of closed loop path 42 through which steps 18 travel, relatively large spacing variations between adjacent steps 18', 18" may create interference problems between skirt plates 54', 54" and bridge member 60, unless bridge member 60 is configured to automatically change position as a function of the relative position of skirt plates 54', 54". For escalator 10 shown in FIG. 1, the transition regions of closed loop path 42 include region 38 between inclined midsection 28 and either of landings 30, 34, and turnarounds 44 where chains 16 and steps 18 travel around sprockets 40 at upper and lower landings 30, 34.

Figure 3:
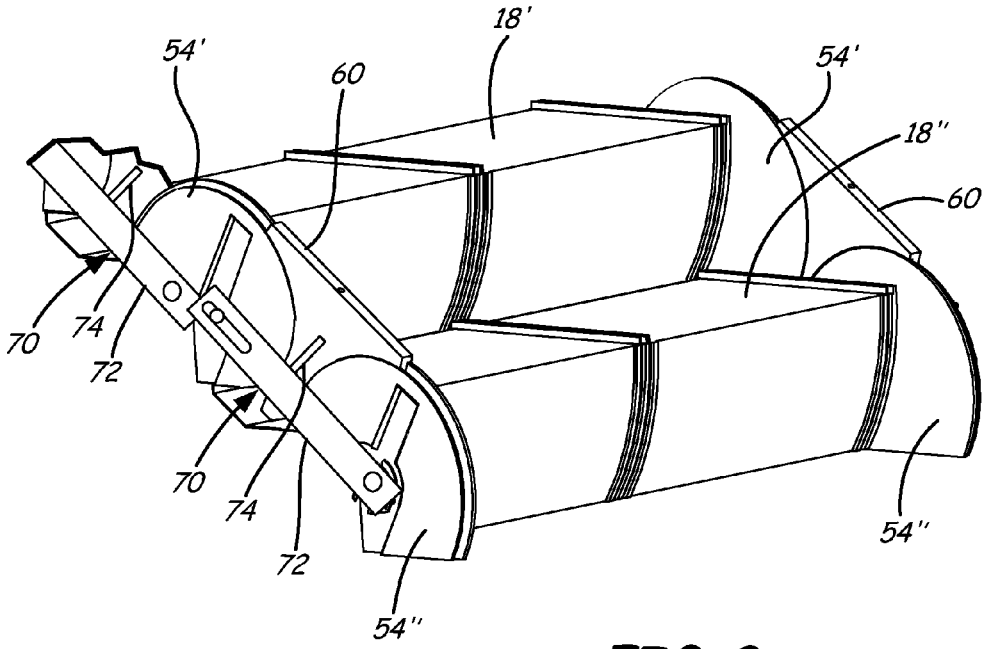
FIG. 3 is a perspective view of adjacent steps including a mechanism that varies the position of a bridge member between the steps as a function of the relative position of the steps to one another.

FIG. 3 is a perspective view of adjacent steps 18', 18" including mechanism 70 that varies the position of bridge member 60 as a function of the relative position of skirt plates 54', 54". In FIG. 3, mechanism 70 includes link 72 pivotally connected to second step 18" and pivotally and slidably connected to first step 18'. The pivotal connections between link 72 and first and second steps 18', 18" may include, for example, bushings, needle and ball bearings, or any other pivotal connection appropriate for the intended application. The sliding connection between link 72 and first step 18', in general, may include any sliding interface between relatively hard, low friction materials including, for example, a metal-on-metal, plastic-on-plastic, and metal-on-plastic interface. Link 72 includes post 74 protruding from link 72 generally between first and second skirt plates 54', 54". Bridge member 60 is arranged between first skirt plate 54' and second skirt plate 54", and is connected to link 72 by post 74. Link 72 does not necessarily function to constrain the relative spacing between steps 18', 18", as this will generally be dictated by the distance between step chain axles that connect the two step chains 12 in escalator 10. Rather, link 72 is configured to push bridge member 60 away from one or both of first skirt plate 54' and second skirt plate 54" in transition regions 38 and 44 of closed loop path 42 through which first and second steps 18', 18" travel in escalator 10.

Figure 4A:
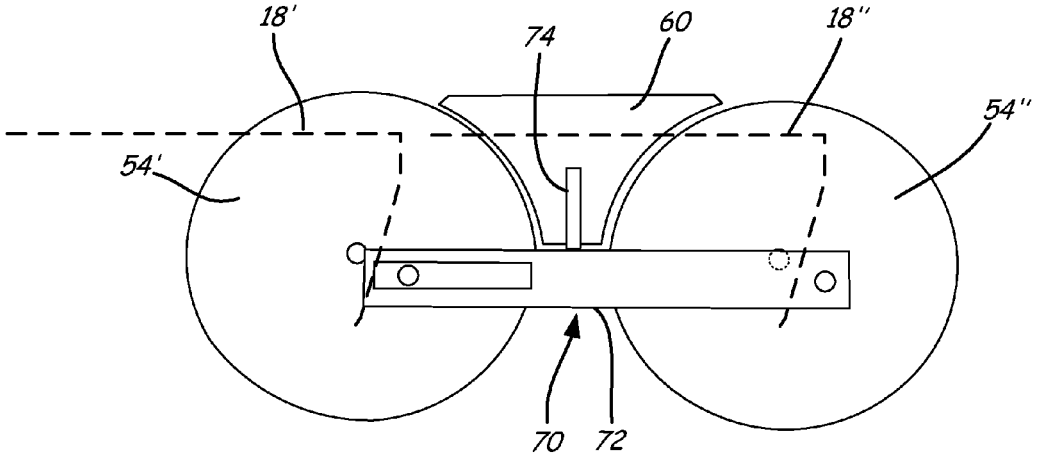
FIGS. 4A and 4B are schematic views of the steps of FIG. 3 showing the relative spacing between steps and the position of the bridge member in different regions of the path through which the steps travel in the escalator of FIG. 1.
Figure 4B:
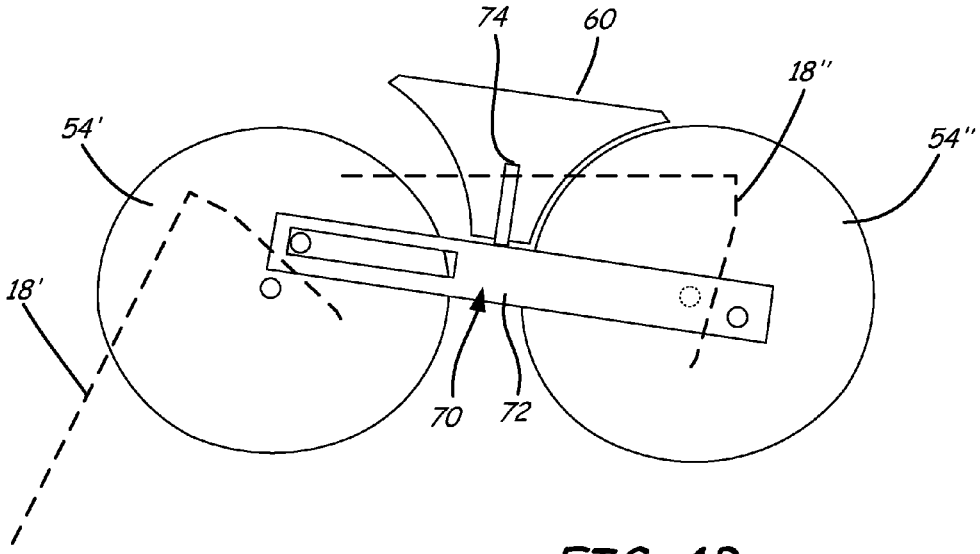

FIGS. 4A and 4B are schematic views of steps 18' and 18" showing the relative spacing between steps and the position of bridge member 60 in different regions of path 42. FIG. 4A shows steps 18, 18" and bridge member 60 in the flat horizontal region of closed loop path 42 at either upper landing 30 or lower landing 34. FIG. 4B shows steps 18', 18" and bridge member 60 entering turnaround 44 from the flat horizontal region at either upper or lower landing 30, 34. In FIG. 4A, the relative spacing of first step 18' and second step 18" remains substantially constant. Link 72 remains generally stationary and therefore bridge member 60 remains arranged between skirt plates 54', 54". Because there are a number of chain links in step chain 16 between axles to which adjacent steps 18', 18" are attached, the spacing between steps 18', 18" may vary in transition regions 38 and 44 of closed loop path 42 as the multiple chain links follow the non-linear shape of the transition regions. In general, the spacing between steps 18', 18" will change any time the chain links in step chain 16 go through an arcuate portion of closed loop path 42, but the amount of change in spacing may be relatively small, as is the case in FIG. 4B. The largest changes in relative spacing between adjacent steps will be in the turnarounds as the steps flip over on their return path from one landing to another. In FIG. 4B, step 18' enters turnaround 44, which in turn alters the relative spacing between step 18' and step 18". The movement of step 18' causes link 72 to push bridge member 60 out and away from the space between skirt plates 54', 54", thereby preventing bridge member 60 from interfering with skirt plates 54', 54" as steps 18', 18" travel through turnaround 44.

Figure 5:
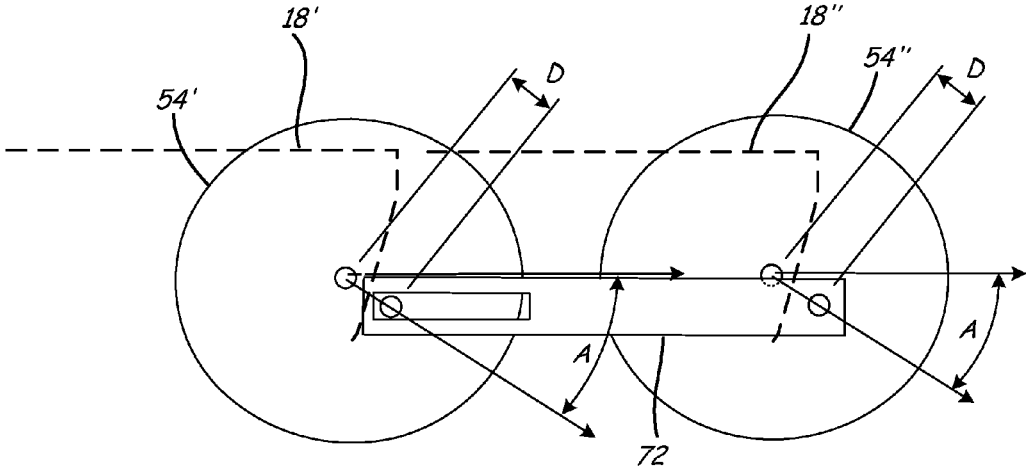
FIG. 5 is a schematic showing one embodiment of the mechanism of FIGS. 3-4B.

FIG. 5 is a schematic showing one embodiment of the present invention with link 72 connected to steps 18', 18". In FIG. 5, link 72 is pivotally connected to second skirt plate 54" offset from a center of skirt plate 54" and is slidably and pivotally connected to first skirt plate 54' offset from a center of skirt plate 54'. In particular, link 72 is connected to skirt plates 54' and 54" at a point offset from horizontal by angle A and offset from the centers of skirt plates 54' and 54" by a distance D. In one embodiment according to the present invention, angle A is approximately equal to 45 degrees and distance D is approximately equal to 25 mm (0.98 inches).

Embodiments according to the present invention include moving skirts employed in chain driven passenger conveyors that are configured to comply with variations in adjacent step spacing in transition regions of the closed loop path through which the steps travel, such as in the turnarounds in the upper and lower landings of an escalator or at either end of a moving walk. Embodiments of the present invention include a mechanism that varies the position of a bridge member arranged between adjacent step skirt plates as a function of the relative position of the skirt plates. The mechanism includes a link pivotally connected to one skirt plate and slidably and pivotally connected to the other skirt plate. The bridge member is connected to the link and the link is configured to push the bridge member away from one or both of the skirt plates in the transition regions of the closed loop path through which the adjacent steps travel in the passenger conveyer system. Embodiments according to the present invention thereby provide a moving skirt adapted to the articulated motion of steps in a chain driven escalator or moving walk.

Although the present invention has been described with reference to particular embodiments, workers skilled in the art will recognize that changes may be made in form and detail without departing from the scope of the invention as defined by the claims listed below.

The invention claimed is:

1. A tread plate assembly for a passenger conveyer system, the assembly comprising:

a first tread plate projecting from a first skirt plate;

a second tread plate projecting from a second skirt plate and arranged adjacent the first tread plate;

a link pivotally connected to the first skirt plate and slidably and pivotally connected to the second skirt plate; and a bridge member connected to the link and arranged between the first skirt plate and the second skirt plate to form a moving skirt of the passenger conveyer system;

wherein the link is configured to vary a position of the bridge member as a function of a relative position of the first and the second skirt plates to one another; and wherein the link is configured to push the bridge member away from one or both of the first skirt plate and the second skirt plate in one or more transition portions of a closed loop path through which the first tread plate and the second tread plate are configured to travel in the passenger conveyer system.

2. The assembly of claim 1, wherein the link is pivotally connected to the first skirt plate offset from a center of the first skirt plate.

3. The assembly of claim 2, wherein the link is connected to the first skirt plate at a point offset from a horizontal plane generally perpendicular to the first skirt plate and passing through the center of the first skirt plate.

4. The assembly of claim 2, wherein the link is slidably and pivotally connected to the second skirt plate offset from a center of the second skirt plate.

5. The assembly of claim 4, wherein the link is connected to the second skirt plate at a point offset from a plane generally perpendicular to the second skirt plate and passing through the center of the second skirt plate by 45 degrees and offset from the center of the second skirt plate by 25 mm (0.98 inches).

6. The assembly of claim 1, wherein the link comprises a post configured to connect the bridge member to the link.

7. The assembly of claim 1, wherein the transition portions of the closed loop path comprise one or more of a transition from an inclined path to a horizontal path and a semi-circular path between two horizontal paths.

8. The assembly of claim 1, wherein a tongue on the bridge member interfaces with a groove on the first skirt plate and a groove on the second skirt plate.

9. The assembly of claim 1, wherein a groove on the bridge member interfaces with a tongue on the first skirt plate and a tongue on the second skirt plate.

10. The assembly of claim 1, wherein the first skirt plate and the second skirt plate are generally circular; and wherein the bridge member is generally triangular and is configured to be received in a space between the first skirt plate and the second skirt plate.

11. A passenger conveyor comprising:

a step chain;

a conveyor drive configured to drive the step chain;

a first tread plate projecting from a first skirt plate and connected to the step chain;

a second tread plate projecting from a second skirt plate and connected to the step chain adjacent the first tread plate;

a link pivotally connected to the first skirt plate and slidably and pivotally connected to the second skirt plate; and a bridge member connected to the link and arranged between the first skirt plate and the second skirt plate to form a moving skirt of the passenger conveyer;

wherein the link is configured to vary a position of the bridge member as a function of a relative position of the first and the second skirt plates to one another: and wherein the link is configured to push the bridge member away from one or both of the first skirt plate and the second skirt plate in one or more transition portions of a closed loop path through which the first tread plate and the second tread plate are configured to travel in the passenger conveyer.

12. The passenger conveyor of claim 11, wherein the link is pivotally connected to the first skirt plate offset from a center of the first skirt plate.

13. The passenger conveyor of claim 12, wherein the link is connected to the first skirt plate at a point offset from a horizontal plane generally perpendicular to the first skirt plate and passing through the center of the first skirt plate.

14. The passenger conveyor of claim 11, wherein the link is slidably and pivotally connected to the second skirt plate offset from a center of the second skirt plate.

15. The passenger conveyor of claim 14, wherein the link is connected to the second skirt plate at a point offset from a horizontal plane generally perpendicular to the second skirt plate and passing through the center of the second skirt plate.

16. The passenger conveyor of claim 11, wherein the link comprises a post configured to connect the bridge member to the link.

17. The passenger conveyor of claim 11, wherein the transition portions of the closed loop path comprise one or more of a transition from an inclined path to a horizontal path and a semi-circular path between two horizontal paths.

18. The passenger conveyor of claim 11, wherein a tongue on the bridge member interfaces with a groove on the first skirt plate and a groove on the second skirt plate.

19. The passenger conveyor of claim 11, wherein a groove on the bridge member interfaces with a tongue on the first skirt plate and a tongue on the second skirt plate.

20. The passenger conveyor of claim 11, wherein the first skirt plate and the second skirt plate are generally circular; and wherein the bridge member is generally triangular and is configured to be received in a space between the first skirt plate and the second skirt plate.

21. A tread plate assembly for a passenger conveyer system, the assembly comprising:

a first tread plate projecting from a first skirt plate;

a second tread plate projecting from a second skirt plate and arranged adjacent the first tread plate;

a link pivotally connected to the first skirt plate and slidably and pivotally connected to the second skirt plate;

a bridge member connected to the link and arranged between the first skirt plate and the second skirt plate to form a moving skirt of the passenger conveyer system;

wherein the link is configured to vary a distance of the bridge member with respect to at least one of the first and second skirt plates as a function of a relative position of the first and the second skirt plates to one another; and wherein the link is configured to push the bridge member away from one or both of the first skirt plate and the second skirt plate in one or more transition portions of a closed loop path through which the first tread plate and the second tread plate are configured to travel in the passenger conveyer system.

22. A passenger conveyor comprising:

a step chain;

a conveyor drive configured to drive the step chain;

a first tread plate projecting from a first skirt plate and connected to the step chain;

a second tread plate projecting from a second skirt plate and connected to the step chain adjacent the first tread plate;

a link pivotally connected to the first skirt plate and slidably and pivotally connected to the second skirt plate;

a bridge member connected to the link and arranged between the first skirt plate and the second skirt plate to form a moving skirt of the passenger conveyer; and wherein the link is configured to vary a distance of the bridge member with respect to at least one of the first and second skirt plates as a function of a relative position of the first and the second skirt plates to one another; and wherein the link is configured to push the bridge member away from one or both of the first skirt plate and the second skirt plate in one or more transition portions of a closed loop path through which the first tread plate and the second tread plate are configured to travel in the passenger conveyer.

* * * * *